US006048590A

United States Patent [19]

Phillips

[11] Patent Number: 6,048,590

[45] Date of Patent: Apr. 11, 2000

[54] SPIRAL CHRISTMAS TREE CONSTRUCTION

[76] Inventor: Willis Phillips, 724 N. Poplar, Centralia, Ill. 62801

[21] Appl. No.: 09/096,260

[22] Filed: Jun. 11, 1998

[51] Int. Cl.[7] ..... A47G 33/06

[52] U.S. Cl. ..... 428/9; 428/20; 428/18; 362/123; 211/196

[58] Field of Search ..... 428/9, 18, 20; 362/123; 211/196

[56] References Cited

U.S. PATENT DOCUMENTS 3,176,123 3/1965 Blake ..... 240/10
3,677,867 7/1972 Westlund ..... 161/14
3,819,459 6/1974 Wren ..... 161/23
4,145,731 3/1979 Adamich ..... 362/123

*Primary Examiner*—Alexander Thomas
*Attorney, Agent, or Firm*—Henderson & Sturm

[57] ABSTRACT

A collapsible spiral Christmas tree construction 10 including a central support unit 11 for supporting a spiral display unit 13 including a spirally wound support member 40 having a plurality of contiguous spiral coils 41 and an adjustable tether unit 14 for varying the effective height and density of said spiral display unit 13.

6 Claims, 1 Drawing Sheet

SPIRAL CHRISTMAS TREE CONSTRUCTION

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of collapsible, artificial Christmas tree constructions.

2. Description of Related Art

As can be seen by reference to the following U.S. Pat. Nos. 3,176,123; 3,677,867; 3,819,459; and 4,145,731, the prior art is replete with myriad and diverse collapsible, artificial Christmas tree constructions.

While all of the aforementioned prior art constructions are more than adequate for the basic purpose and function for which they have been specifically designed, they are uniformly deficient with respect to their failure to provide a simple, efficient, and practical spirally configured collapsible Christmas tree construction wherein the effective height and density of the conical shape of the tree construction can be varied to satisfy personal preferences.

As most individuals are all too well aware, the theory of one size fits all is just that, a theory which does not translate well into most practical situations.

As a consequence of the foregoing situation, there has existed a longstanding need for a new and improved collapsible Christmas tree construction wherein the effective height and density of the decorative portion of the conically shaped configuration can be varied to suit an individual's particular preferences, and the provision of such a construction is a stated objective of the present invention.

BRIEF SUMMARY OF THE INVENTION

Briefly stated, the spiral Christmas tree construction that forms the basis of the present invention comprises in general, a vertical support unit, a base unit, a spiral display unit, and an adjustable tether unit for varying the effective height and density of the spiral display unit.

As will be explained in greater detail further on in the specification, the vertical support unit comprises a vertical support rod member whose lower end is secured in the base unit and whose upper end supports the center of the spiral display unit.

In addition, the spiral display unit comprises a spirally wound support member having a plurality of contiguous spiral coils. The adjustable tether unit is operatively associated with the spiral display unit and comprises a plurality of tether members and a plurality of clamp members associated with each of the tether members to adjustably support the spiral coils of the spiral display unit.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
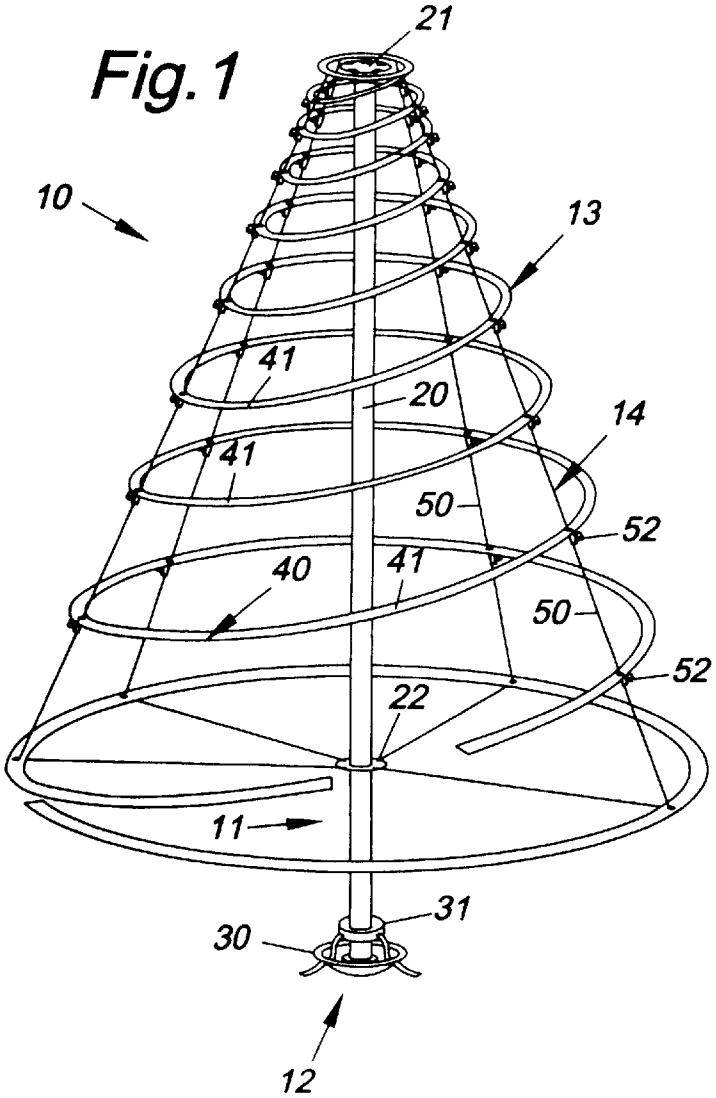
FIG. 1 is a perspective view of the spiral Christmas tree construction that forms the basis of the present invention.

As can be seen by reference to the drawings, and in particularly to FIG. 1, the spiral Christmas tree construction that forms the basis of the present invention is designated generally by the reference number 10. The construction 10 comprises in general, a vertical support unit 11, a base unit 12, a spiral display unit 13, and an adjustable tether unit 14. These units will now be described in seriatim fashion.

As can be seen by reference to FIG. 1, the vertical support unit 11 comprises an elongated vertical support rod member 20 having a cap element 21 disposed on the upper end and an adjustable height hub element 22 disposed proximate to, but spaced form, the lower end. In addition, the base unit 12 comprises a conventional base member 30 having a central portion 31 dimensioned to receive the lower end of the vertical support rod member 20 in a well recognized fashion.

Figure 3:
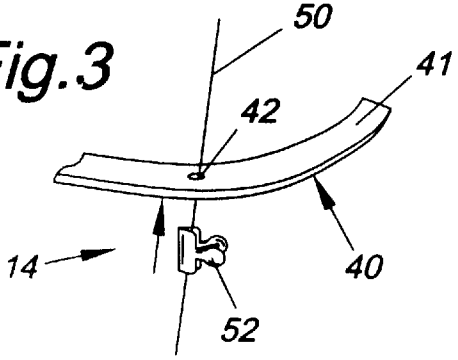
FIG. 3 is an isolated detail view of the adjustable tether unit.

Turning now to FIGS. 1 and 3, it can be seen that the spiral display unit 13 comprises a generally flat spirally wound support member 40 fabricated from a generally rigid, yet flexible, disk of material such as plastic, sheet metal, or the like. The disk of material may be stamped or cut in a conventional fashion to provide a series of integrally formed spiral coils 41 which assume a flat configuration in their related state, and which assumes a generally conical Christmas tree configuration when the center of the spirally wound support member 40 is suspended from the cap element 21 of the vertical support rod member 20 as depicted in FIG. 1.

As can best be seen by reference to FIGS. 2 and 3, the contiguous spiral coils 41 of the spirally wound support member 40 are further provided with a plurality of spaced apertures 42 which are arrayed in an aligned radial fashion on the adjacent spiral coils 41, 41 for reasons that will be explained presently.

Returning once more to FIGS. 1 through 3, it can be seen that the adjustable tether unit 14 comprises a plurality of elongated tether members 50 wherein each of the tether members are dimensioned to be threadedly received in one radially aligned row of apertures 42 in the respective spiral coils 41, 41 of the spirally wound support member 40.

In addition, the adjustable tether unit also includes a plurality of clamp members 52 which are operatively associated with each of the apertures 42 on each of the spiral coils 41. The clamp members 52 are designed to captively engage the elongated tether members 50 below and adjacent to the point where the tether members 50 pass through the apertures 42 to provide support to the spiral coils 41 of the spirally wound support member 40.

Figure 2:
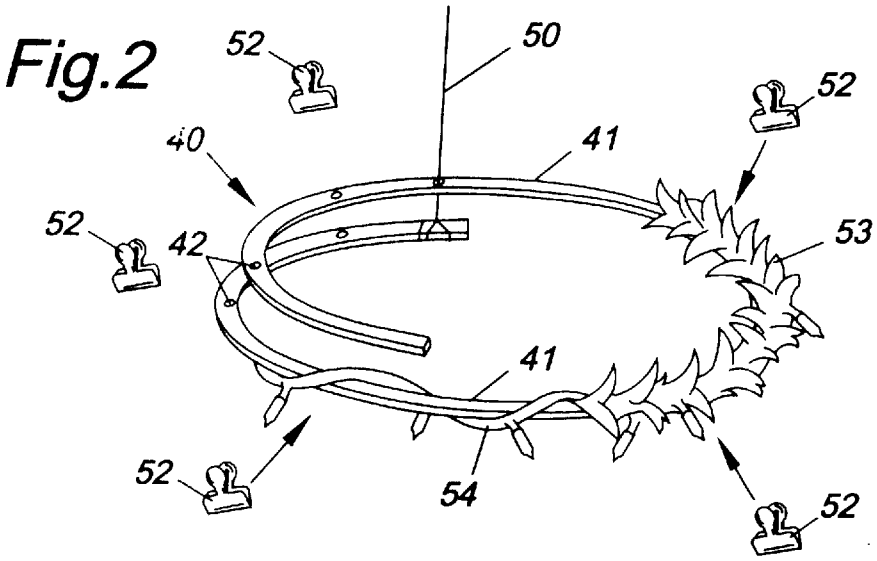
FIG. 2 is an isolated detail view of one of the spiral coils of the Christmas tree construction.

In addition, as shown in FIG. 2, the clamp members 52 can also serve to anchor garland strings 53 and strings of lights 54 to the helical coils 44 to produce an enhanced aesthetically pleasing effect to the finished Christmas tree construction.

As was mentioned previously, the effective height and density of the spirally wound support member 40 may be adjusted wherein the lower ends of each of the tether members 50 are connected to the hub element 22 which is adjustably mounted on the vertical support rod member 20. It being understood that the same practical effect could also be accomplished by the judicial placement of the clamp members 52 beneath the largest spiral coil.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

What is claimed is:

1. A collapsible Christmas tree construction comprising:

a central support unit including an elongated tubular vertical support rod member having an upper end and a lower end;

a base unit including a base member having a central portion dimensioned to receive and captively engage the lower end of the vertical support rod member;

a spiral display unit including a generally rigid spirally wound generally flat support member having a plurality of contiguous spiral coils provided with a plurality of radically aligned rows of apertures wherein the central portion of the spirally wound support member is operatively associated with the upper end of the vertical support rod member; and means for adjusting the effective height and density of said spiral display unit.

2. The construction as in claim 1 further including an adjustable tether unit including a plurality of tether members wherein each of said tether members is dimensioned to be threadedly received in one of said radially aligned rows of apertures.

3. The construction as in claim 2 wherein each of said tether members is further provided with a plurality of clamp members operatively associated with one of said radially aligned rows of apertures.

4. The construction as in claim 3 wherein said clamp members are adapted to selectively engage strings of decorative elements associated with said spiral coils.

5. The construction as in claim 4 wherein said decorative elements comprise garland strings, and strings of lights.

6. The construction as in claim 2 wherein the central support member further includes an adjustable height hub element which is spaced from the lower end of the vertical support rod member and operatively attached to the lower portion of each of said plurality of tether members.

* * * * *